US011071367B2

(12) United States Patent
Arellano et al.

(10) Patent No.: US 11,071,367 B2
(45) Date of Patent: Jul. 27, 2021

(54) APPARATUS FOR APPLYING COSMETICS

(71) Applicant: Melt Cosmetics, Chatsworth, CA (US)

(72) Inventors: Laura Arellano, Porter Ranch, CA (US); Dana Bomar, Woodland Hills, CA (US); Jacky Gunter, Westlake Village, CA (US); Stephen Corsi, Westlake Village, CA (US); Dale Woiken, Upland, CA (US)

(73) Assignee: Melt Cosmetics, Chatsworth, CA (US)

( * ) Notice: Subject to any disclaimer, the term of this patent is extended or adjusted under 35 U.S.C. 154(b) by 0 days.

(21) Appl. No.: 16/379,574

(22) Filed: Apr. 9, 2019

(65) Prior Publication Data

US 2019/0231052 A1 Aug. 1, 2019

Related U.S. Application Data

(63) Continuation of application No. 15/406,767, filed on Jan. 15, 2017, now Pat. No. 10,278,476.

(60) Provisional application No. 62/279,636, filed on Jan. 15, 2016.

(51) Int. Cl.

| | |
|---|---|
| ***A46B 11/00*** | (2006.01) |
| ***A45D 34/04*** | (2006.01) |
| ***A45D 40/26*** | (2006.01) |

(52) U.S. Cl.

CPC ..... *A45D 34/046* (2013.01); *A45D 34/042* (2013.01); *A45D 34/045* (2013.01); *A45D 40/264* (2013.01); *A45D 40/265* (2013.01); *A45D 40/267* (2013.01); *A45D 34/043* (2013.01); *A45D 2200/1072* (2013.01)

(58) Field of Classification Search

CPC ..... A46B 2200/1046; A45D 40/262; A45D 40/264; A45D 40/265; A45D 40/267; A45D 34/042; A45D 34/043; A45D 34/045

See application file for complete search history.

(56) References Cited

U.S. PATENT DOCUMENTS

| | | | | |
|---|---|---|---|---|
| 3,694,096 | A * | 9/1972 | Seidler | A45D 33/00 401/127 |
| 5,913,631 | A * | 6/1999 | Landry | A45D 40/265 401/127 |
| 6,164,859 | A * | 12/2000 | Hambright | B42D 1/08 281/38 |
| 8,529,147 | B2 * | 9/2013 | Delage | A45D 40/267 401/127 |
| 8,944,712 | B2 * | 2/2015 | Thorpe | A45D 34/045 132/218 |
| 2017/0049214 | A1 * | 2/2017 | Pope | A45D 40/264 |

* cited by examiner

*Primary Examiner* — Jennifer C Chiang

(74) *Attorney, Agent, or Firm* — Buchalter, A Professional Corporation; Kari L. Barnes

(57) ABSTRACT

The apparatus for dispensing cosmetics has a bottle portion configured to hold the cosmetics product, a wiper structure at an open end of the bottle portion; and a closure portion.

18 Claims, 15 Drawing Sheets

APPARATUS FOR APPLYING COSMETICS

PRIORITY

This application is a continuation of U.S. patent application Ser. No. 15/406,767, filed Jan. 15, 2017, which claims the benefit of U.S. Provisional Patent Application No. 62/279,636, filed on Jan. 15, 2016, each of which is incorporated by reference in its entirety.

BACKGROUND

There are existing products consisting of bottles with closures containing an applicator with a tip; however, these designs lack is a sleeve to allow the more accurate position of gripping of the applicator mechanism near the tip of the applicator and without their fingers coming into contact with the liquid cosmetic material.

Prior to the present invention, there has always been a need to have containers to hold liquid cosmetics that are easy to carry and that can be opened and closed to prevent the make-up material from getting outside of the bottle during transport. There is also a need for an apparatus for applying cosmetics that can be used for application of the liquid cosmetic product on the user's facial area without the liquid coming into contact with the hands or fingers of the user.

From the preceding descriptions, it is apparent that the devices currently being used have significant disadvantages. Thus, important aspects of the technology used in the field of invention remain amenable to useful refinement.

SUMMARY

This invention relates to an apparatus for holding, dispensing, and applying liquid cosmetics including without limitation an eyeliner product. This apparatus can also be used medically as an applicator for treatments, ointments, salves or lotions.

The apparatus has a closure portion and a bottle portion; the closure portion holds the eyeliner mechanism. The eyeliner mechanism comprises: a sliding sleeve, a compression spring, a stem and an applicator tip, which is connected to a first end of the stem; the second end of the stem has a cap or end portion; the closure portion has a body or housing that covers the eyeliner mechanism; the sliding sleeve with the stem allows the eyeliner mechanism to have a first or retracted position and a second extended position. When the mechanism is removed from the bottle, the sleeve extends over the first end of the stem and allows the user to grip the eyeliner mechanism near the applicator without getting the liquid cosmetic product onto their fingers. The sliding sleeve can be moved over the stem with use of at least one compression springs or manual tabs and grooves.

An apparatus for applying a cosmetics product by a user comprising: a bottle portion and a closure portion; the bottle portion has a first bottle portion end and a second bottle portion end; the bottle portion holds the cosmetics product; the first bottle portion end is closed; the second bottle portion end is open and has a wiper structure; the wiper structure is hollow and has a first wiper end and a second wiper end; the first wiper end can be smaller in diameter to the second wiper end; the closure portion has an eyeliner mechanism, which comprises: a sliding sleeve, which is hollow and has a first sleeve end and a second sleeve end; the first sleeve end and the second sleeve end are open; the first sleeve end can have a smaller opening than the second sleeve end; an outer surface of the first sleeve end can be tapered; the first sleeve end can have a lip or a raised ridge that can push against the bottle or the wiper; at least one compression spring with a first spring end and a second spring end; the first spring end engages a spring holder groove within the second sleeve end; a stem, which has a first stem end and a second stem end; the compression spring is situated around the stem or oriented around the stem; an applicator tip or brush, which is connected to a first end of the stem; the second end of the stem can have a cap end and an engagement area for the second spring end; the second spring end can press against the engagement area on the cap end or the second end of the stem; the closure portion has a housing for the eyeliner mechanism; the housing has a first housing end and a second housing end; the first housing end has a removable attachment (threaded, friction or magnetic) to connect to the second end of the bottle portion; the second housing end engages the cap end on the second stem end, or the second housing end is connected to the second stem end; the wiper structure allows the applicator tip on the first stem end to engage the cosmetics product within the bottle portion; the compression spring and the stem allows the sliding sleeve to have a first retracted position and a second extended position, whereby in the first retracted position, the sliding sleeve is pushed into the housing, and the applicator tip engages the cosmetics product within the bottle portion; and whereby in the second extended position, when the closure portion is separated from the bottle portion, the compression spring expands and the sliding sleeve extends over the first end of the stem and allows the user to grip the eyeliner mechanism near the applicator tip without getting the cosmetic product onto fingers of the user.

The wiper can have a resistance point; the first end of the sliding sleeve can engage the resistance point on the wiper. The wiper structure allows the first stem end and the applicator tip to engage the cosmetics product within the bottle portion; a lip structure on the second bottle portion end and the stem help and also allow the eyeliner mechanism to have a first retracted position and a second extended position, whereby in the first retracted position, the applicator tip engages the cosmetics product within the bottle portion; and when the eyeliner mechanism within the closure portion is removed from the bottle portion, the sliding sleeve extends over stem and allows the user to grip the sliding sleeve and the eyeliner mechanism near the applicator tip without getting the cosmetic product onto fingers of the user; the second bottle portion can have a wiper structure, which can have a groove, which engages a lip on the first sleeve end; the bottle portion can have a lip; and the first end of the sliding sleeve can press against the lip in the first retracted position; the second end of the stem has a groove, notch or receptor for engaging the second end of the compression spring; the stem can have a tapered and graduated outer surface.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LIST

10 Apparatus;
15 Bottle portion;
20 Closure portion;
25 Sliding Sleeve;
30 Compression Spring;
35 Stem;
40 First End of Stem;
45 Second End of Stem;
50 Applicator Tip/Wand;
55 Wiper structure;
60 first bottle portion end;
65 second bottle portion end;
70 cosmetics product;
75 first wiper end;
80 second wiper end;
85 eyeliner mechanism;
90 first sleeve end;
95 second sleeve end;
100 lip on the first sleeve end;
105 first spring end;
110 second spring end;
115 spring holder groove within the second sleeve end;
120 bump, boss on second sleeve end;
125 stabilizing fins on outer surface of second end of sleeve
130 cap end;
135 engagement area for the second spring end;
140 housing for the eyeliner mechanism;
145 first housing end;
150 second housing end;
155 a removable attachment to connect to the second end of the bottle portion; threaded connections, friction connections or magnetic connections;
160 resistance point on wiper;
165 Channel or slot on housing for closure portion;
170 Tab;
175 First end of tab; and
180 Second end of tab.

DESCRIPTION

As shown in FIG. 1-15, there is an apparatus for applying liquid make-up and cosmetics, which has a closure portion and a bottle portion; the closure portion holds the eyeliner mechanism. The bottle portion holds the cosmetics material, including without limitation a liquid cosmetic; the bottle portion can also have a wiper, rings, seals or one-way valves to prevent leakage of the liquid cosmetic.

The eyeliner mechanism includes: a sliding sleeve or sheath, one or more compression springs, a stem and an applicator tip (wand or brush), which is connected to a first end of the stem; the second end of the stem can have a cap or end portion (which can engage one end of the compress 10*n* spring); the closure portion has a body or housing that holds the eyeliner mechanism.

The closure portion can removably engage the bottle portion, including using a friction connection, a threaded connection or a magnetic connection. The closure portion can include without limitation: stem, compression spring, sliding sleeve, barrel or housing or tabs or fins on the sliding sleeve.

The bottle portion has a bottle body, which is a reservoir to hold the make-up or cosmetics or any material to be applied with the application tip or brush; the first end of the bottle portion is closed; the second end of the bottle portion is open and can also include a wiper; the wiper can also have an opening that engages the applicator tip of the eyeliner mechanism.

Figure 1:
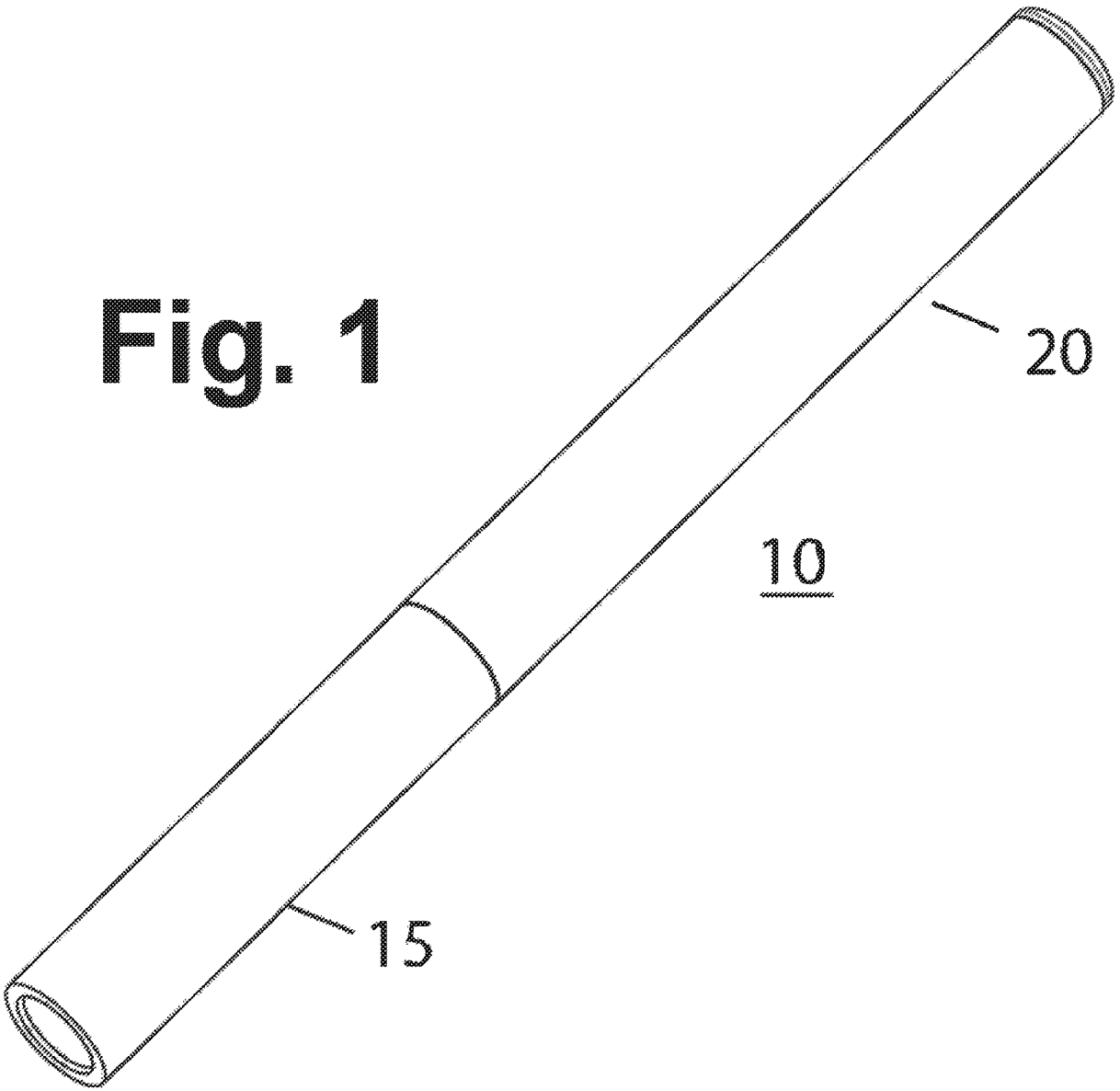
FIG. 1 is a perspective view of one embodiment of the invention.
Figure 2:
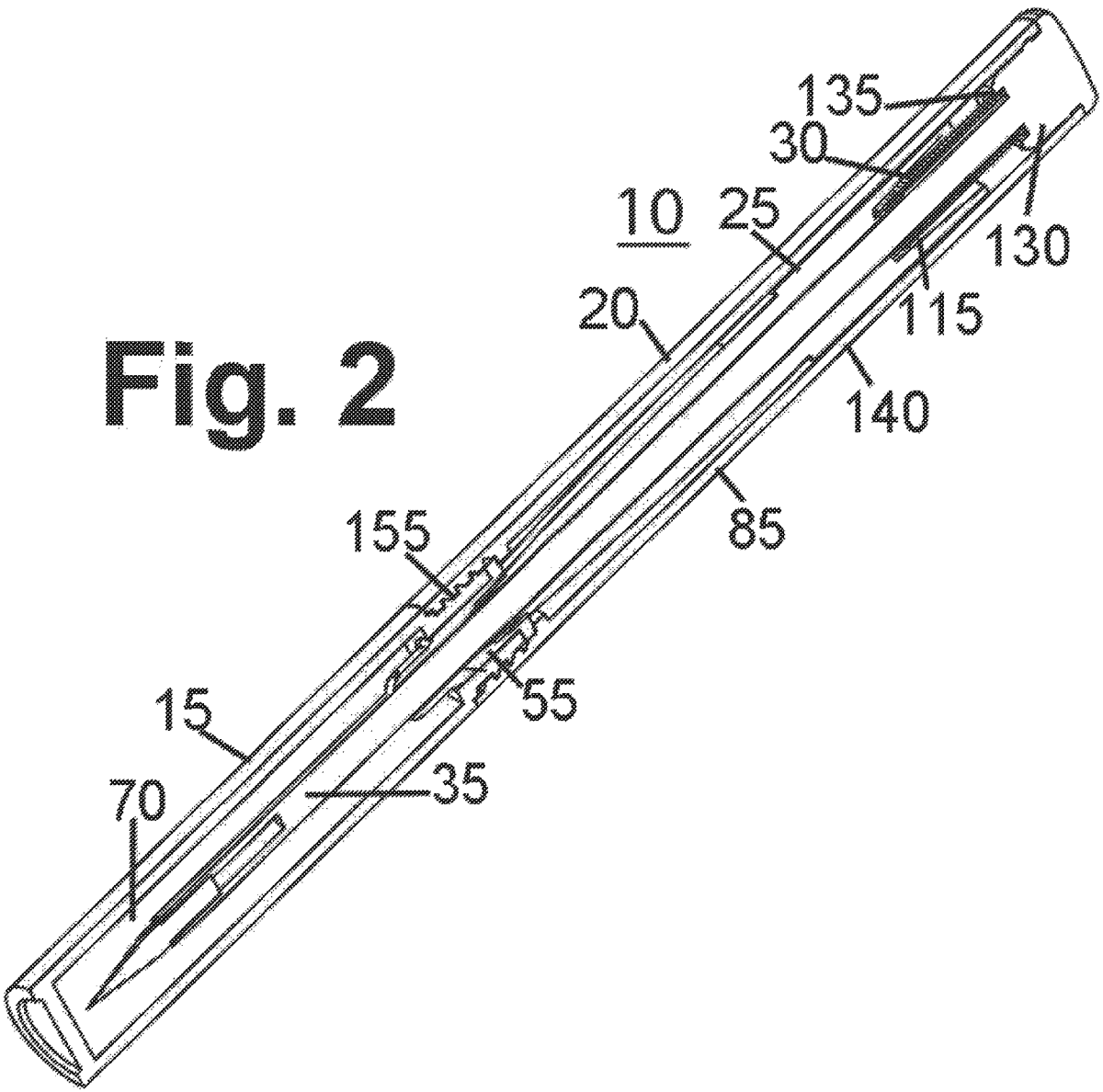
FIG. 2 is a cross-sectional view of the embodiment of FIG. 1.
Figure 3:
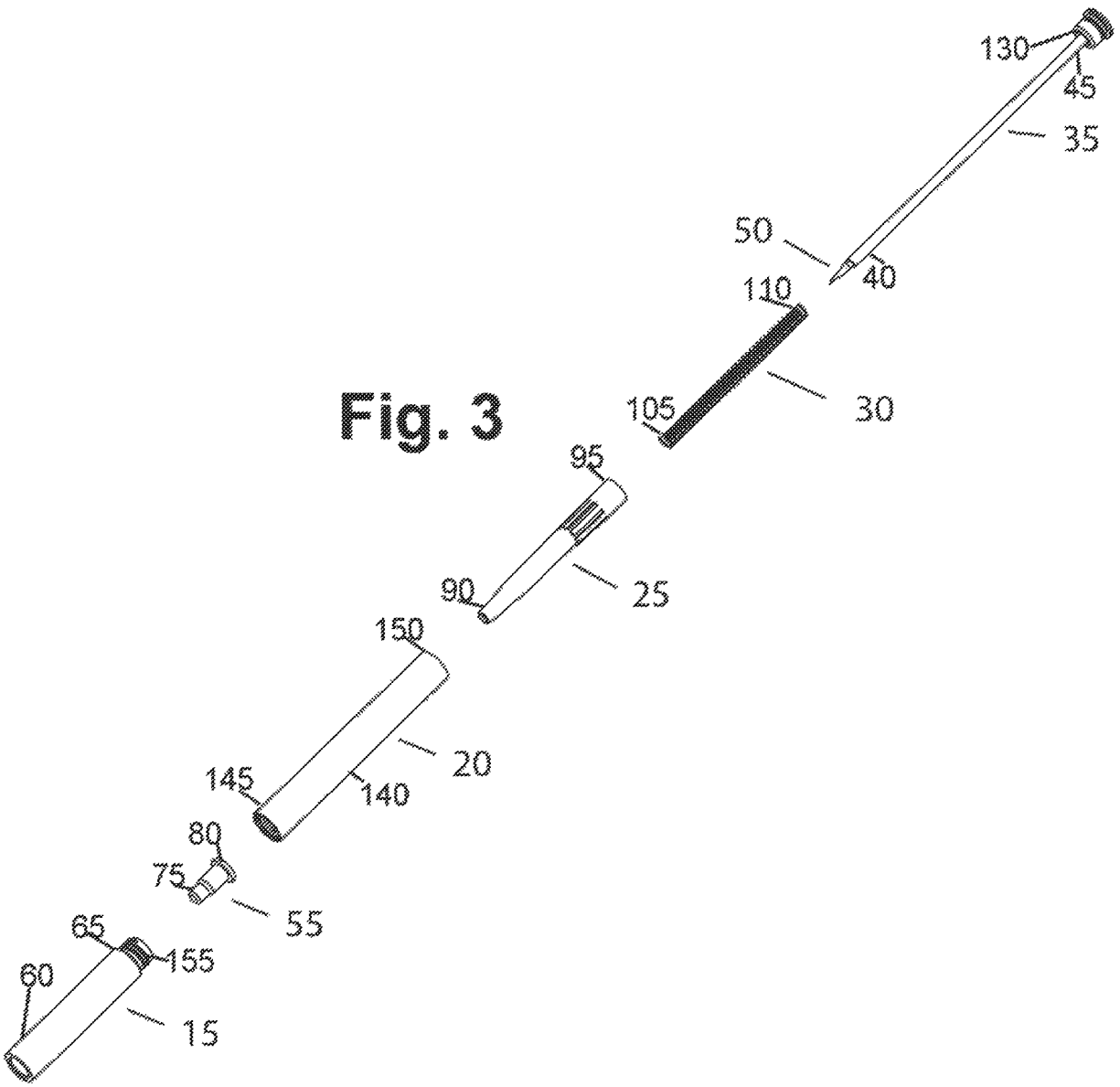
FIG. 3 is an exploded view of one embodiment of the invention.

When the bottle and closure portions are engaged together, the stem engages the compression spring against the sliding sleeve, so that the eyeliner mechanism is in the first or retracted position; here, the applicator tip is placed deep within the bottle reservoir; the applicator tip can engage the material within the bottle. (FIGS. 1 and 2).

Figure 4:
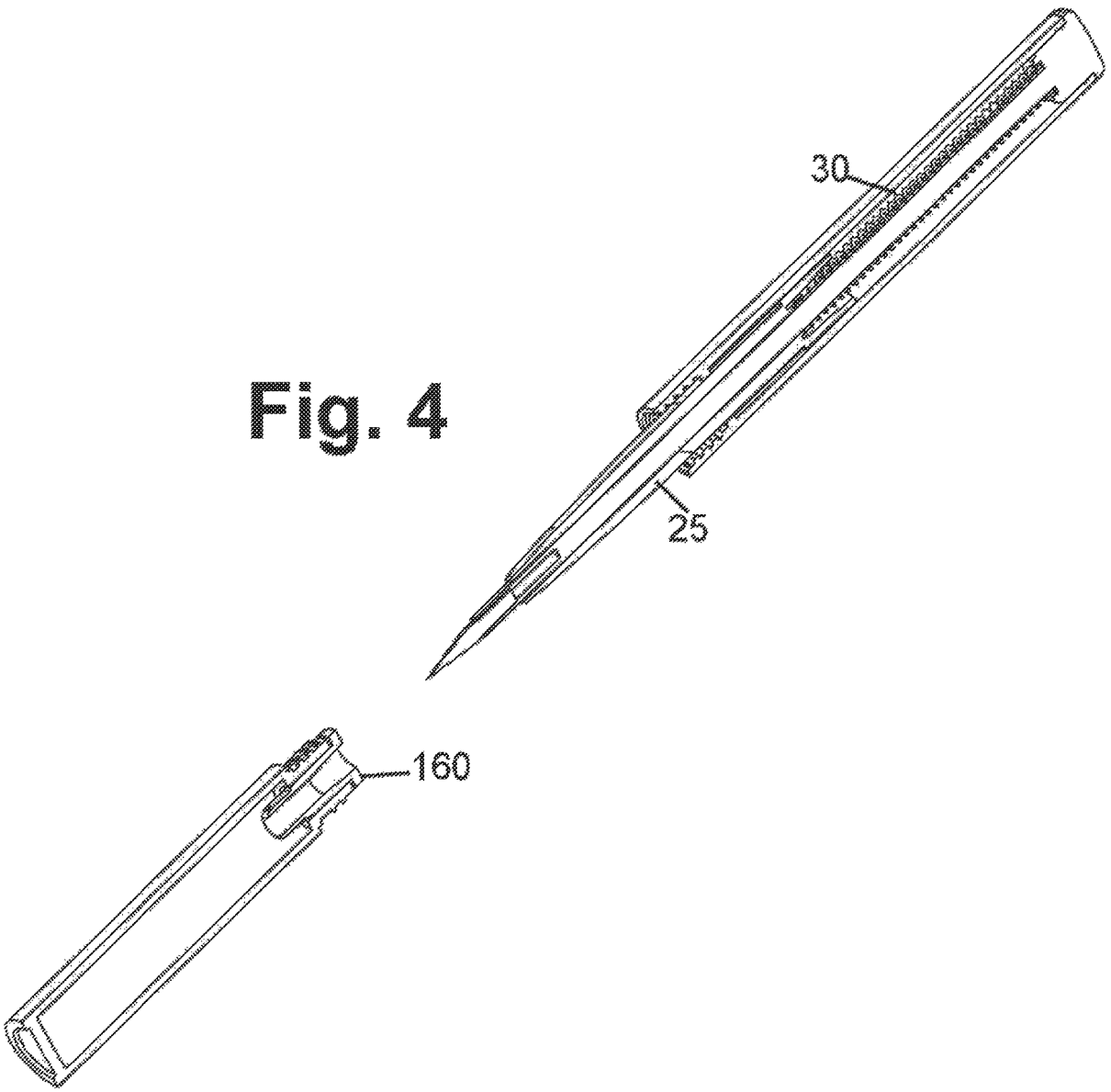
FIG. 4 is a cross-sectional view of the embodiment in the extended or second position.
Figure 5:
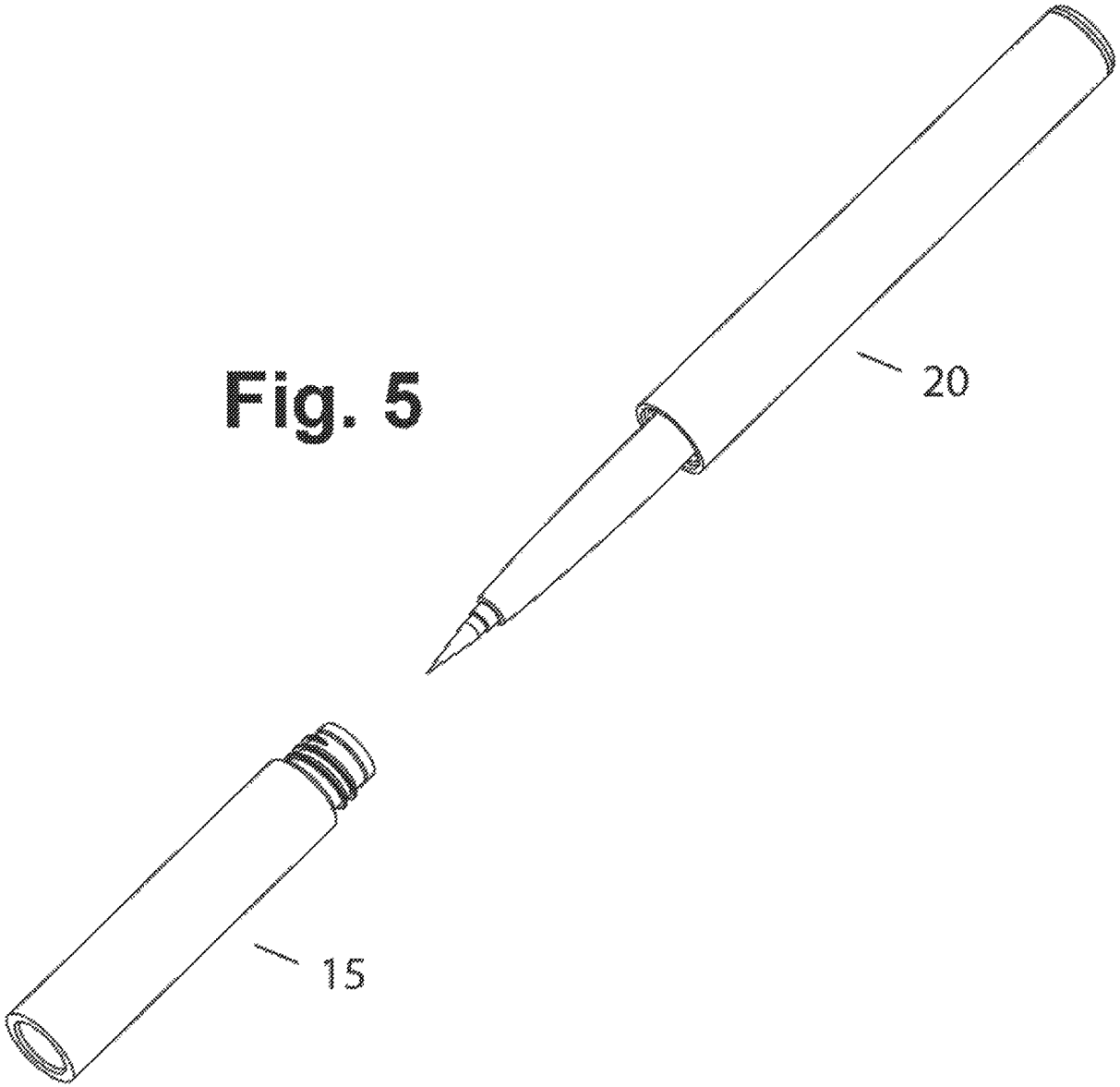
FIG. 5 is a perspective view of the embodiment shown in FIG. 4.

When the bottle and closure portions are released or threaded apart, the second end of the stem no longer engages the compression spring against the sliding sleeve, so that the eyeliner mechanism is in the second or extended position, and the sliding sleeve can move and covers the first end of the stem, so that the user can more easily grasp the apparatus and near the applicator tip; the applicator tip is exposed and ready to apply the make-up to where the user places the applicator tip. (FIGS. 4 and 5).

This embodiment has a sliding sleeve over a stem having an applicator tip; this structure allows the user can hold the apparatus closer to the applicator tip without getting the core product on their fingers, which would generally be the case with the existing art.

Bottle: The bottle portion has a first bottle portion end and a second bottle portion end; the bottle portion holds the cosmetics product (liquid or solid); the first bottle portion end is closed; the second bottle portion end is open and can have a wiper structure. In other embodiments, the bottle can have a lip at the second bottle end that can engage the first end of the sliding sleeve and to provide a point of resistance so that the sleeve can be pushed into the first or retracted position and up the stem; the lip further enables movement of the sliding sleeve from the first retracted position to the second extended position. The bottle portion can be opaque or transparent or have a visual marking or indicator of how much cosmetic material is remaining.

Wiper: The wiper structure can be hollow and can have a first wiper end and a second wiper end; the first wiper end can be smaller in diameter to the second wiper end; as shown in the close-up view in FIG. 6, the first wiper end can have an inner surface that is a smaller diameter or dimension than the inner surface of the second wiper end; the inner surface of the second wiper end can also be tapered or slanted; these differences in dimensions between the first and the second ends of the wiper allow the wiper to provide a point of resistance against the first end of the sliding sleeve.

Figure 6:
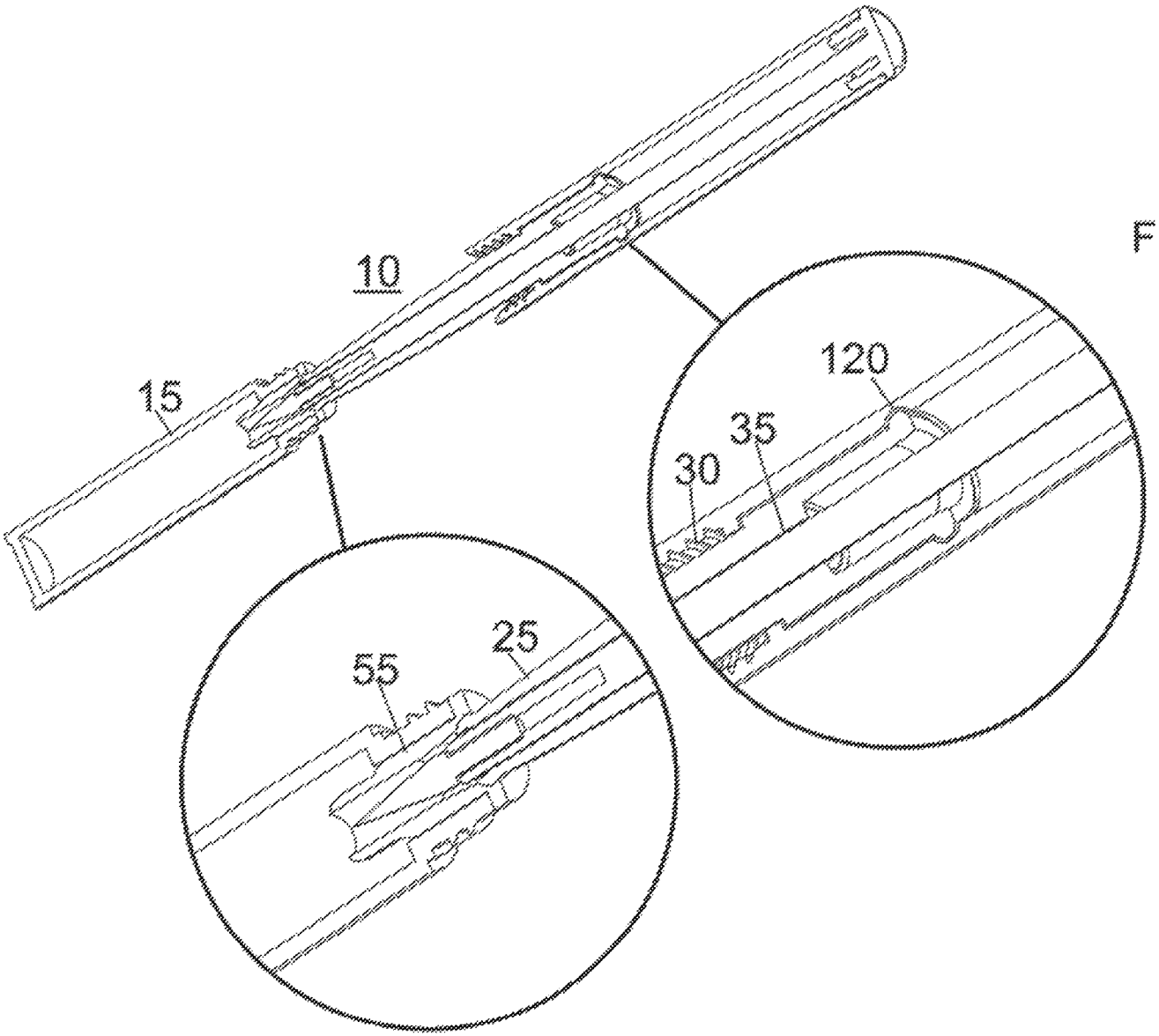
FIG. 6 is a cross-sectional view of another embodiment of the invention without use of a compression spring; the first close-up window shows the first end of the sliding sleeve engaging the wiper on the bottle portion; the second close-up window shows the second end of the sliding sleeve.
Figure 7:
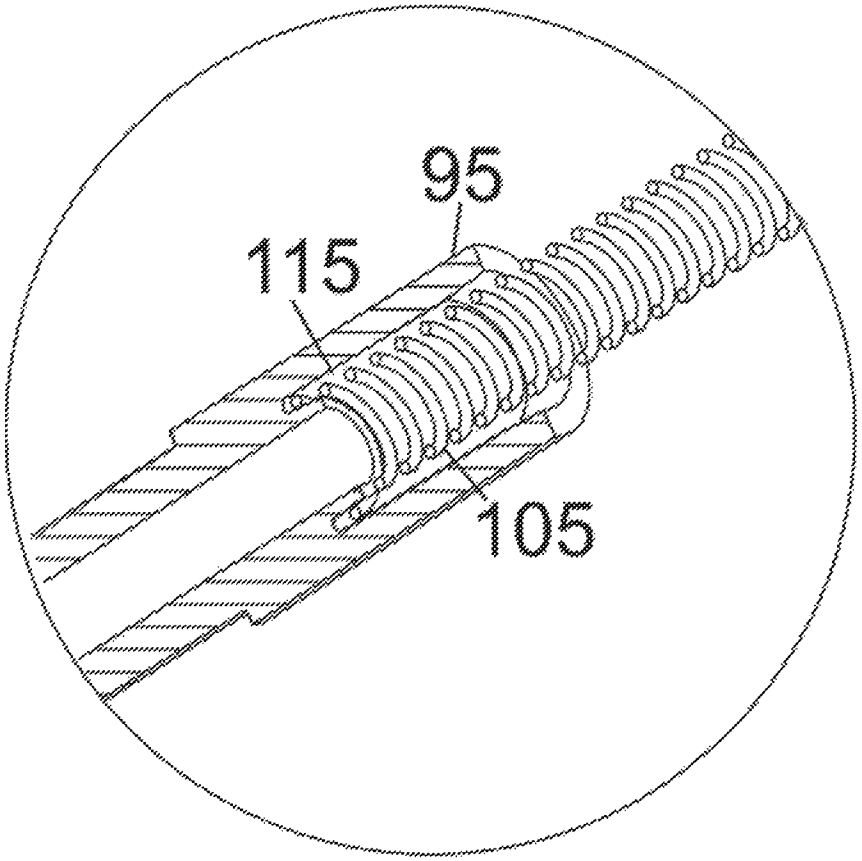
FIG. 7 is a close up and cross-sectional view of another embodiment of the invention; namely the first end of the compression spring engaging a groove, space, lip, flange or slot within the second end of the sliding sleeve.
Figure 8:
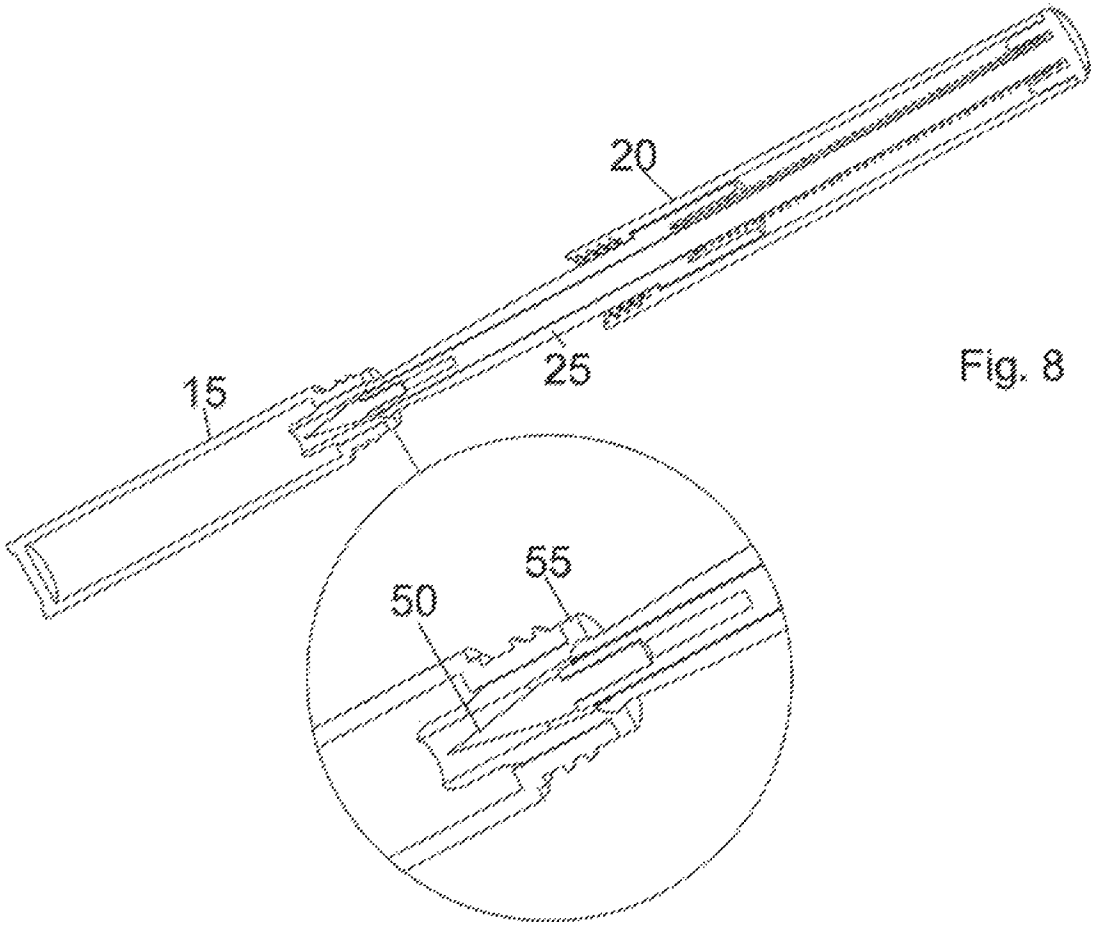
FIG. 8 is a cross-sectional view of another embodiment of the invention with use of a compression spring; the close-up window shows the first end of the sliding sleeve engaging the wiper on the bottle portion; the inner surface of the second end of the wiper is of a wider dimension than the inner surface of the first end of the wiper.
Figure 9:
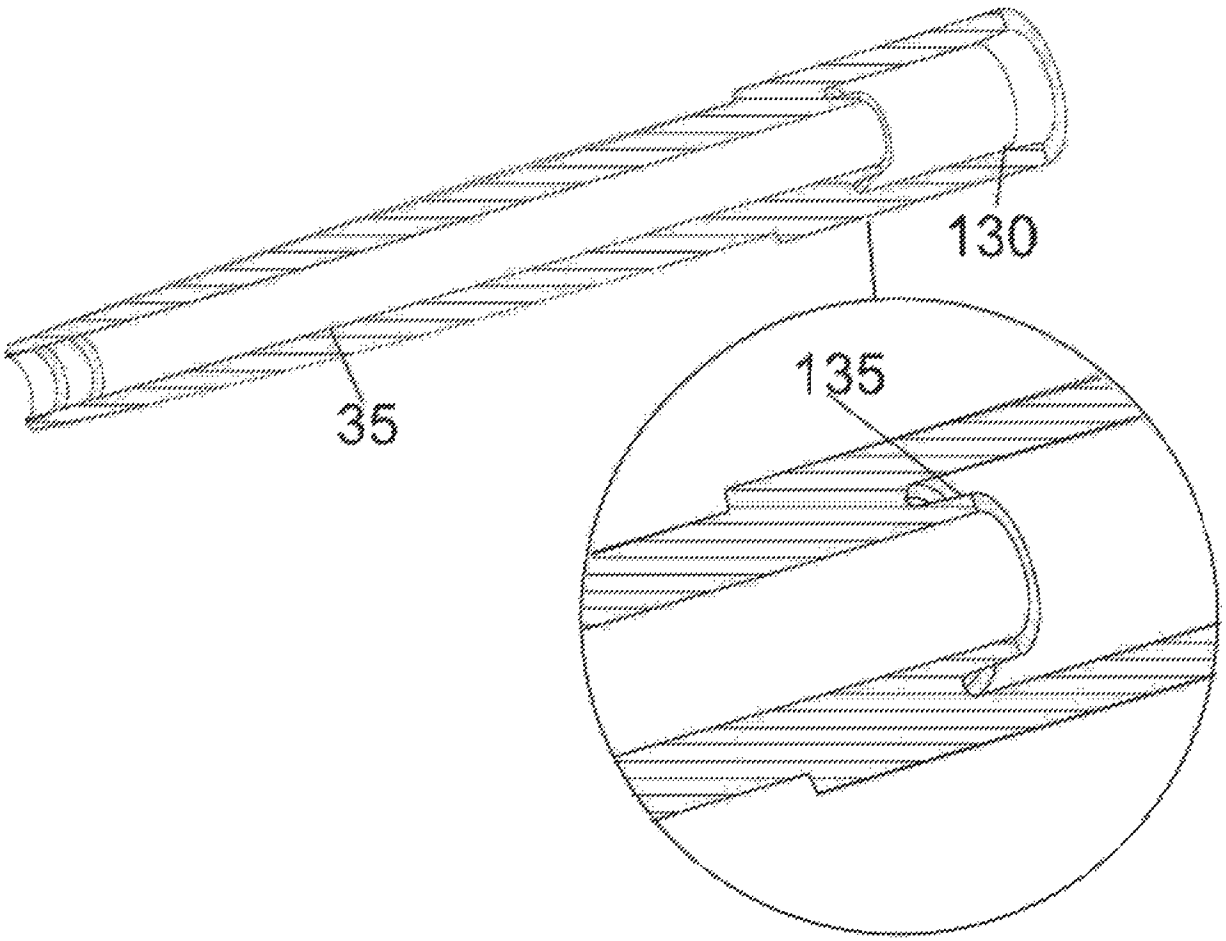
FIG. 9 is a partial cross-sectional view of the second end of the stem, namely the groove, space or slot to engage the second end of the compression spring.
Figure 10:
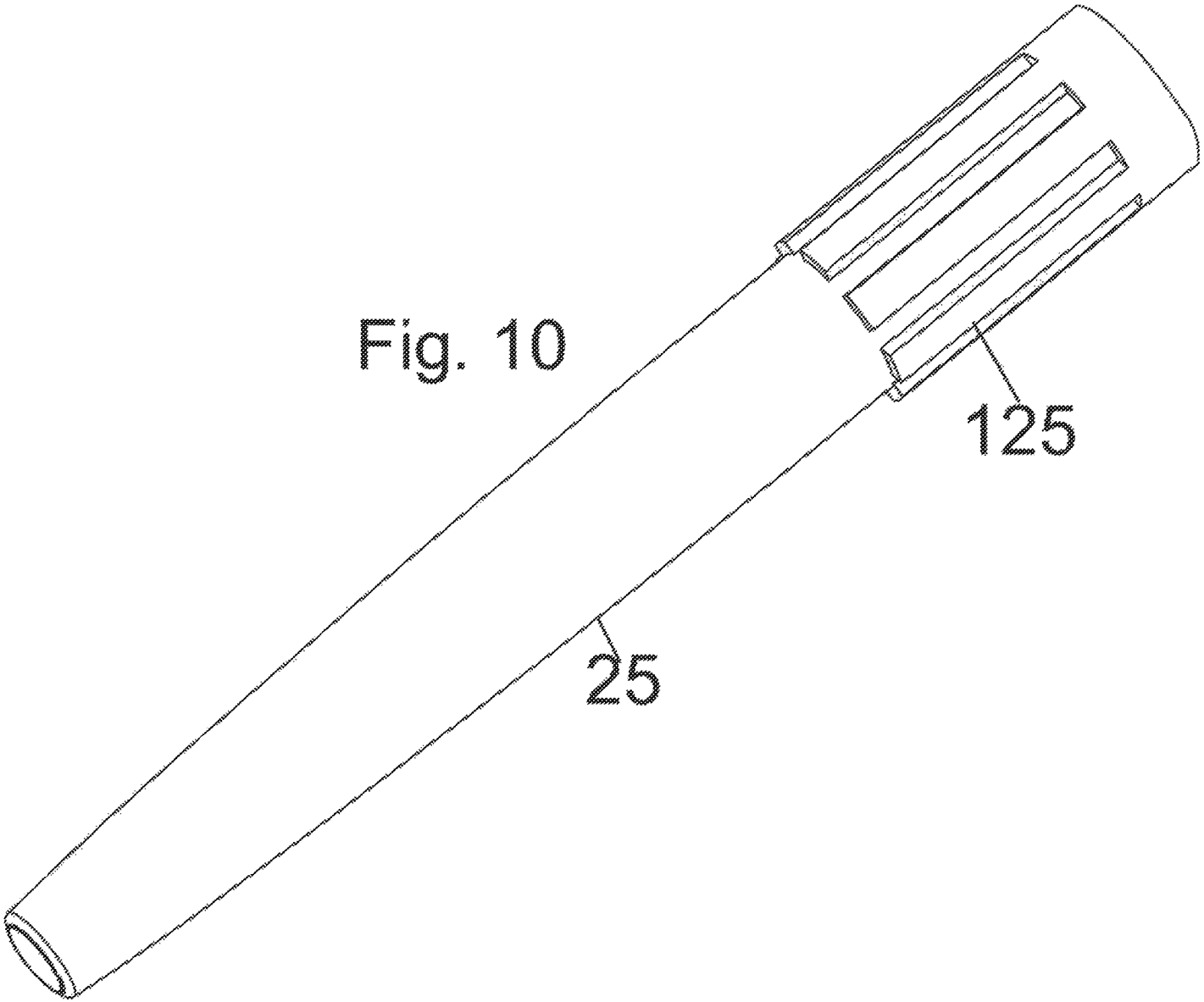
FIG. 10 is a perspective view of the sliding sleeve or sheath and the stabilizing fin structures on the second end of the sliding sleeve. These fins could also be one continuous ring such that the first end of the sleeve has a different outside dimension than the second end of the sleeve.
Figure 11:
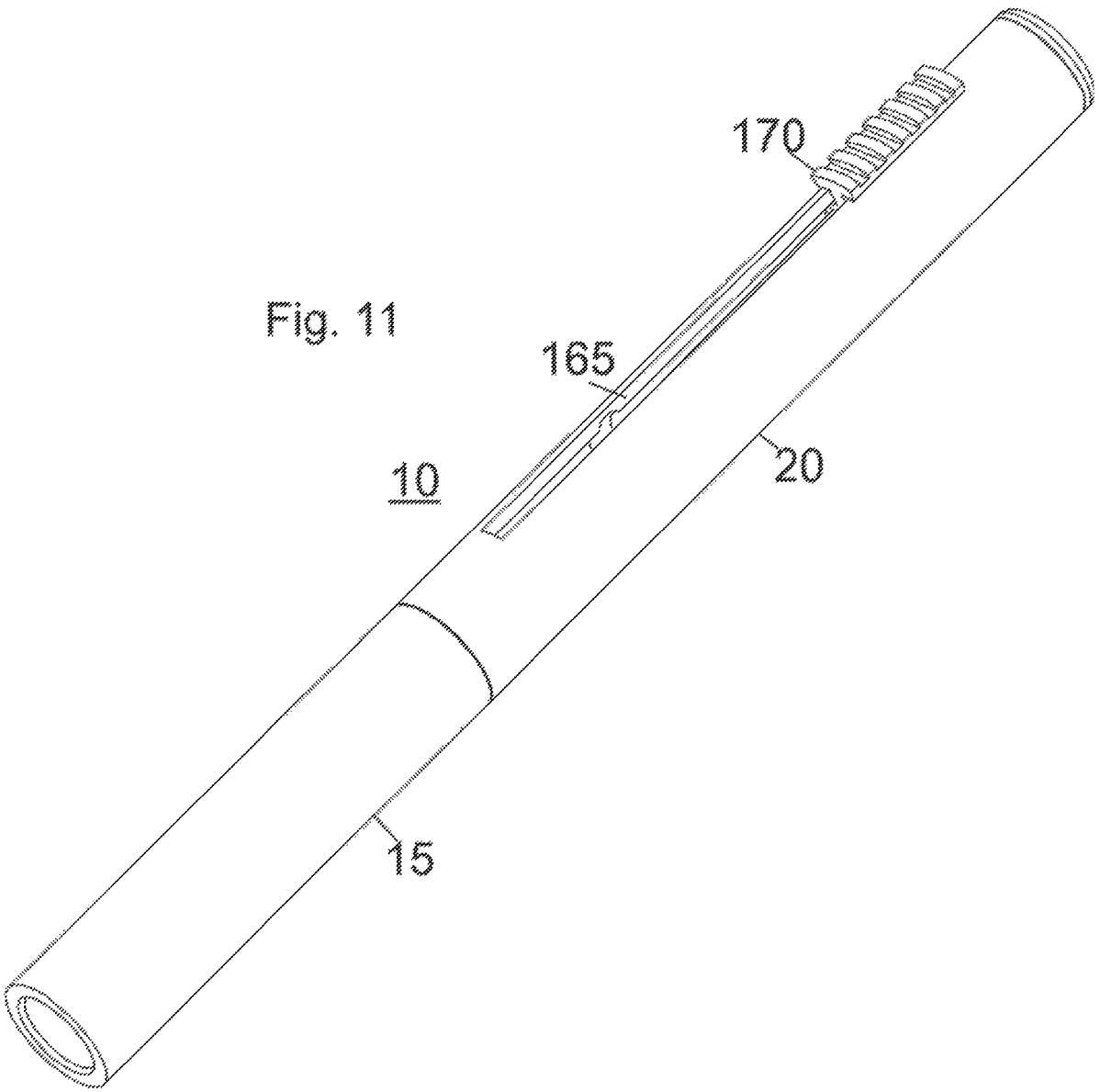
FIG. 11 is a perspective view of another embodiment of the invention, wherein the sliding sheath or sleeve is moved from the first retracted position to a second extended position by manually sliding the sleeve from the first position to the second position; the user can engage a tab to slide the sleeve.
Figure 12:
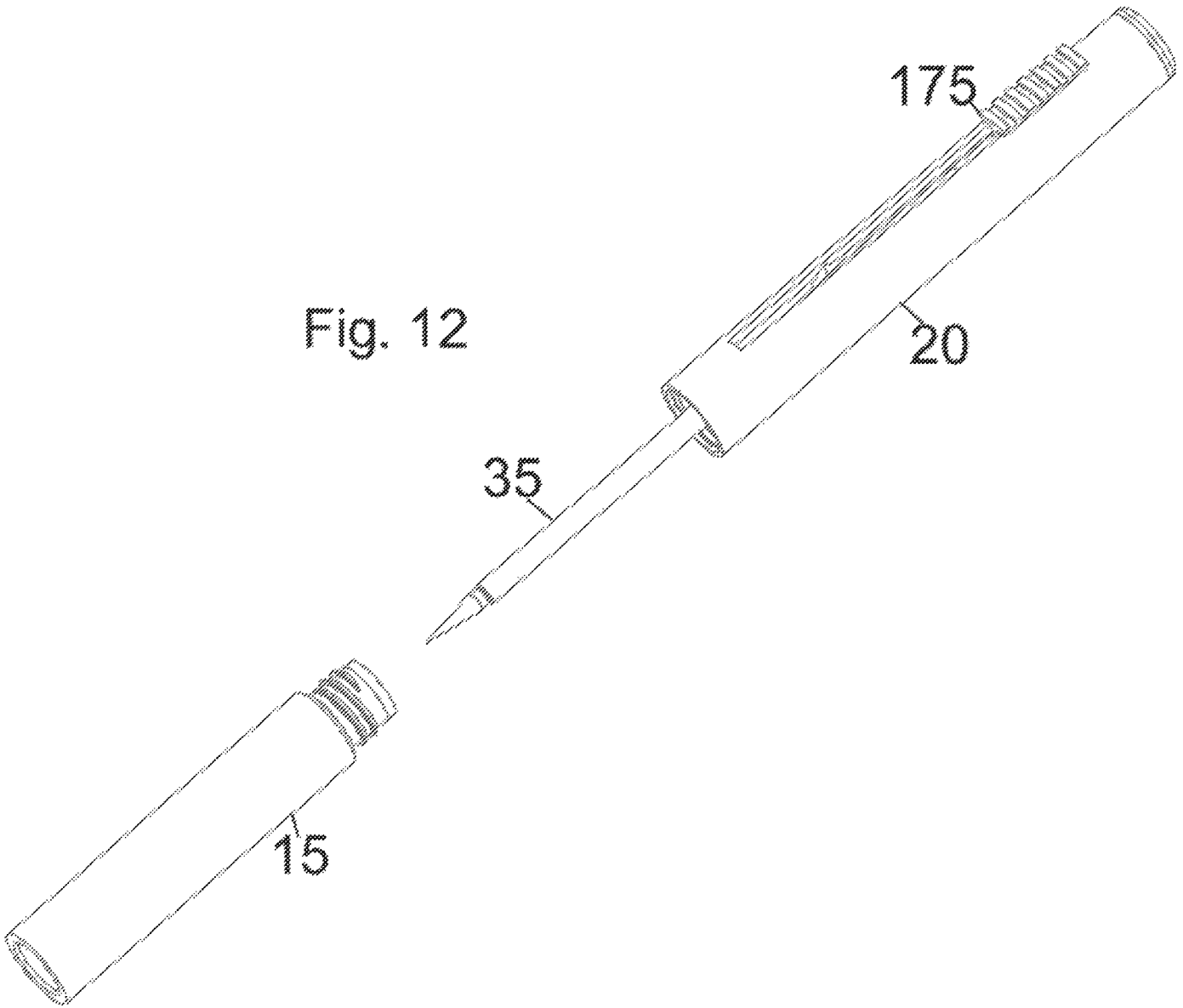
FIG. 12 is a perspective view of the embodiment of FIG. 11, wherein the bottle portion is disengaged or separated from the closure portion; the sliding sleeve is in the first or retracted position.
Figure 13:
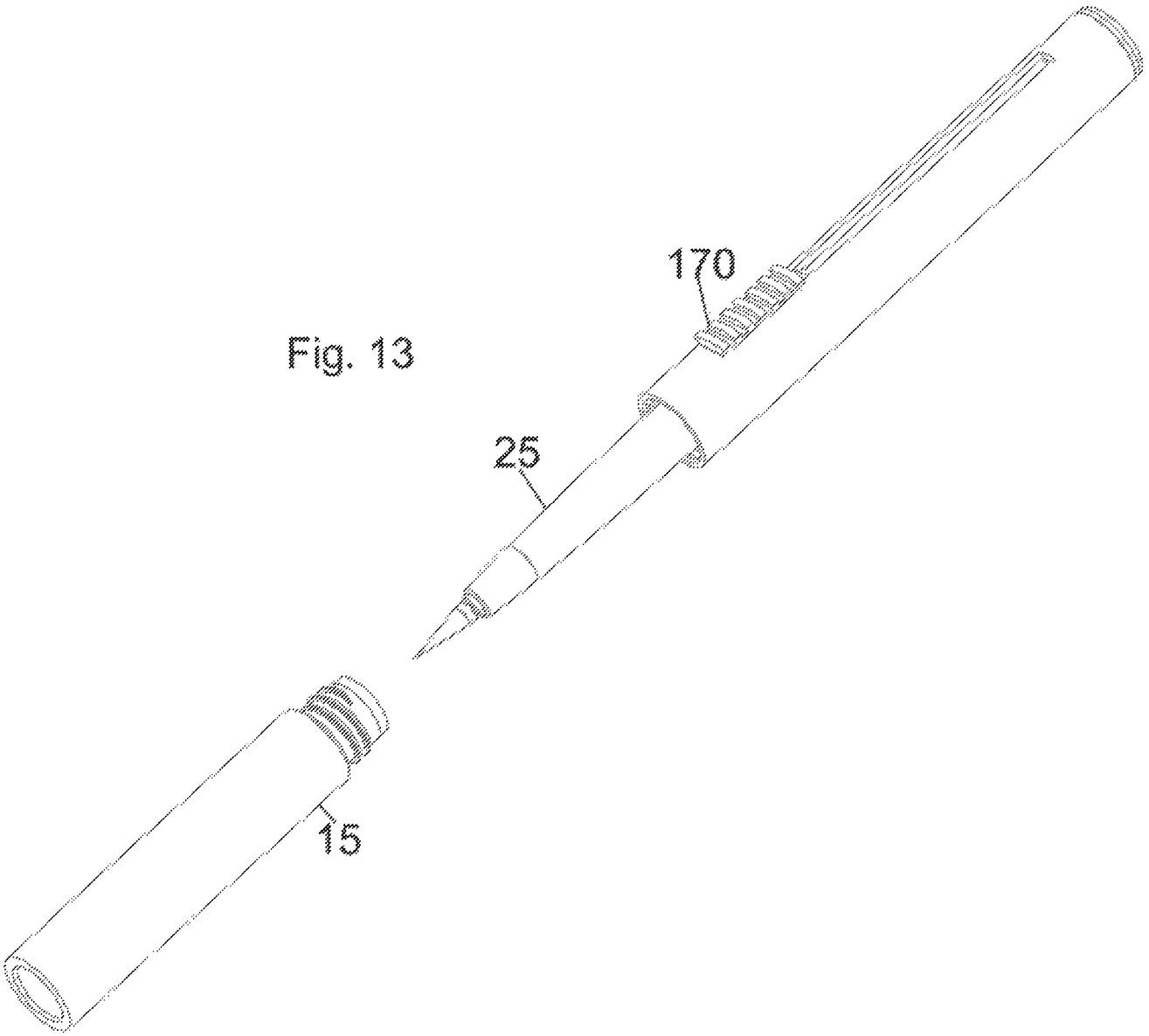
FIG. 13 is a perspective view of the embodiment of FIG. 11, wherein the bottle portion is disengaged or separated from the closure portion; the sliding sleeve is in the second or extended position. The sleeve now covers the first end of the stem so that the user can place their fingers closer to the application tip when applying the cosmetic material to their face or body.

In FIG. 8, one preferred embodiment (use of the spring) of the invention provides that the wiper has a concentric groove, ledge or space on the inside surface or at an edge of the second end of the wiper so that a corresponding feature, bump, boss or lip on the first end of the sliding sleeve can be engaged and to provide resistance so that when the bottle portion is attached to the closure portion, the sliding sleeve is pushed into the first or retracted position from the second or extended position and up the length of the stem. The wiper can also have a resistance point; the first end of the sliding sleeve can engage the resistance point on the wiper. In FIG. 6, another embodiment (no spring) can use this concentric groove, ledge or space on the inside surface of the second end of the wiper to provide the point of resistance to move the sliding sleeve into the first or retracted position from a second or extended position.

The wiper structure allows the applicator tip on the first stem end to engage the cosmetics product within the bottle portion; the wiper can employ one-way valve or have a selective opening to prevent inadvertent leaking of the cosmetic material within the bottle portion. The wiper is generally attached to the bottle portion, but other embodiments allow for the wiper to be attached to the housing or another location on the closure portion.

Sliding Sleeve: The eyeliner mechanism can have a sliding sleeve or sheath, which is hollow and has a first sleeve end and a second sleeve end; the first sleeve end and the second sleeve end are open; the first sleeve end can have a smaller opening or dimension than the second sleeve end.

The outer surface of the first sleeve end can be tapered or have a different outside dimension than the second sleeve end; the sliding sleeve is able to be positioned around the stem; both the outer and the inner surfaces of the sliding sleeve and/or the outer surface of the stem can have a graduated or textured surface, fins, grooves, ridges or ribs to help control the movement of the sleeve up and down the stem. The first sleeve end can have a lip, boss or protruding portion that can engage a corresponding groove, ledge or space on the second end of the wiper or the bottle portion.

Springs: The eyeliner mechanism can employ at least one compression spring with a first spring end and a second spring end; the first spring end can fit or engage a spring holder groove within the second sleeve end. Other embodiments of the invention can omit a spring to move the sleeve up and down the stem (FIG. 6). Other embodiments in FIG. 11-15 employ a manual tab to move the sleeve from the first to the second position. A second compression spring can be positioned below the first compression spring and dampens the sliding sleeve when moving from the first retracted position to the second extended position.

Stem: There is a stem, which has a first stem end and a second stem end; the compression spring is situated around or oriented around the stem. An applicator tip or brush head can be connected to a first end of the stem. The second end of the stem can have a cap end or an engagement area, groove or circular divot for engagement or catching of the second spring end; the second spring end can press against this engagement area on the stem. The stem can have a textured or a graduated surface, which helps slow the sliding sleeve when moving to the second extended position.

Housing: The closure portion has a housing for the eyeliner mechanism; the housing has a first housing end and a second housing end; the housing ends can be open, and the housing can be hollow; the first housing end has a removable attachment (threaded, magnetic or friction) to connect to the second end of the bottle portion; the second housing end can engaged or fixed to the cap end on the second stem end. The second end of the compression spring can also engage an area on the second end of the housing instead of an engagement area on the second end of the stem and near the cap end; in this version, the second end of the housing is closed.

The compression spring and the stem allow the sliding sleeve to have a first or retracted position and a second or extended position. In the first retracted position, the sliding sleeve is pushed into the housing, and the applicator tip engages the cosmetics product within the bottle portion; and in the second extended position, when the closure portion is separated from the bottle portion, the compression spring expands, and the sliding sleeve extends over the first end of the stem and allows the user to grip the eyeliner mechanism near the applicator tip without getting the cosmetic product onto fingers of the user.

In addition, in FIG. 6, the second bottle portion end (including use of a lip structure) and the stem allow the eyeliner mechanism to have a first retracted position and a second extended position, whereby in the first retracted position, the applicator tip engages the cosmetics product within the bottle portion; and when the eyeliner mechanism within the closure portion is removed from the bottle portion, the sliding sleeve extends over stem and allows the user to grip the sliding sleeve and the eyeliner mechanism near the applicator tip without getting the cosmetic product onto fingers of the user.

Movement of the sliding sleeve along the stem allows the eyeliner mechanism to have a first retracted position and a second extended position; in the first retracted position, the sliding sleeve moves so that the applicator tip engages the cosmetics product within the bottle portion; and in the second extended position, when the eyeliner mechanism within the closure portion is removed from the bottle portion, the sliding sleeve extends over the stem and allows the user to grip the sliding sleeve and the eyeliner mechanism near the applicator tip without getting the cosmetic product onto fingers of the user.

Manual Version: FIG. 11-15 show another preferred embodiment of the invention, wherein the sliding sheath or sleeve is moved from the first retracted position to a second extended position by manually sliding the sleeve from the first position to the second position; the user can engage a tab to slide the sleeve; when the bottle portion is disengaged or separated from the closure portion; the sliding sleeve is in the first or retracted position; the user can then use the tap to move the sliding sleeve from a first position to a second position; the sleeve now covers the first end of the stem so that the user can place their fingers closer to the application tip when applying the cosmetic material to their face or body.

Figure 14:
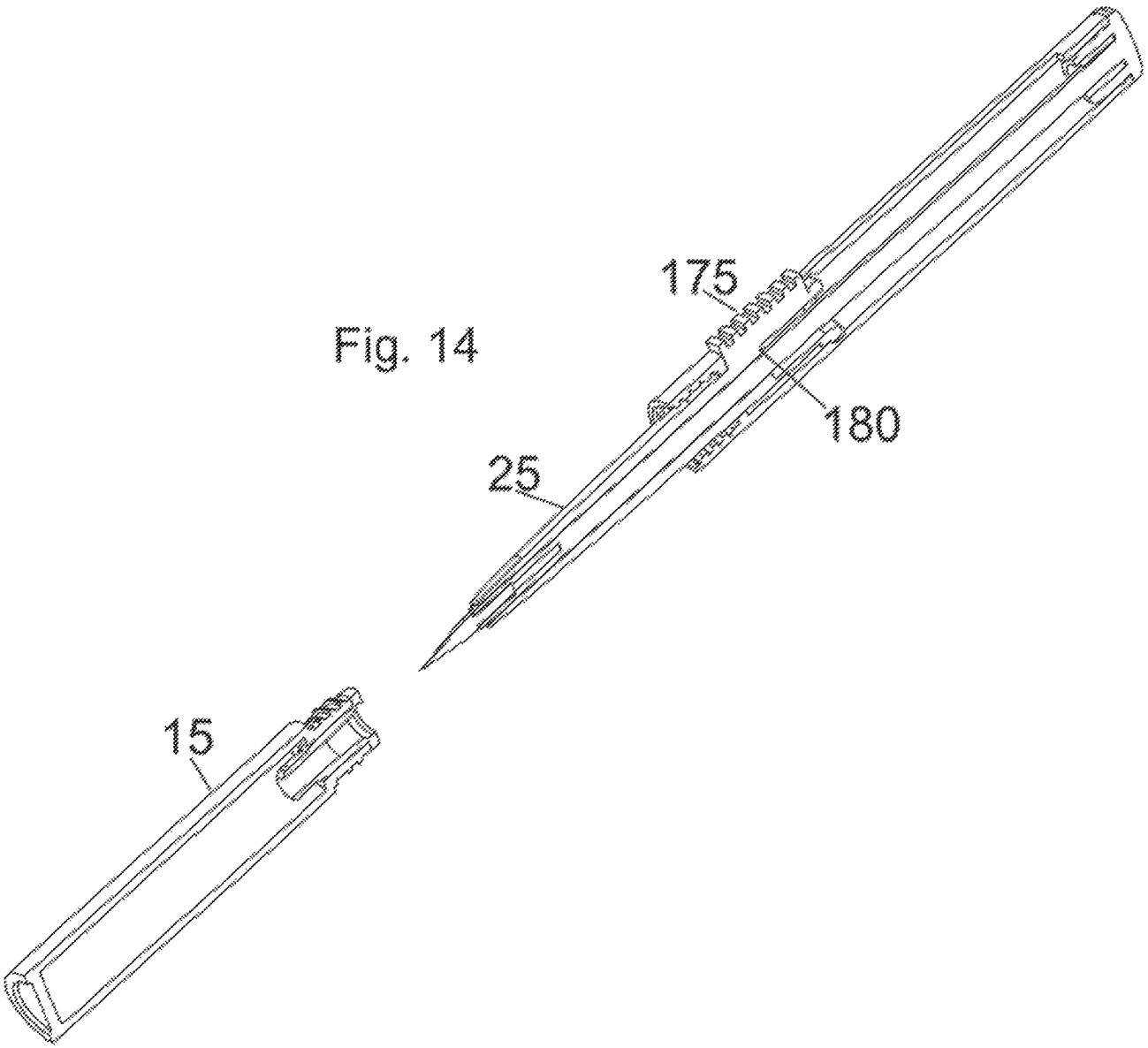
FIG. 14 is a cross-sectional view of the embodiment shown in FIG. 13.
Figure 15:
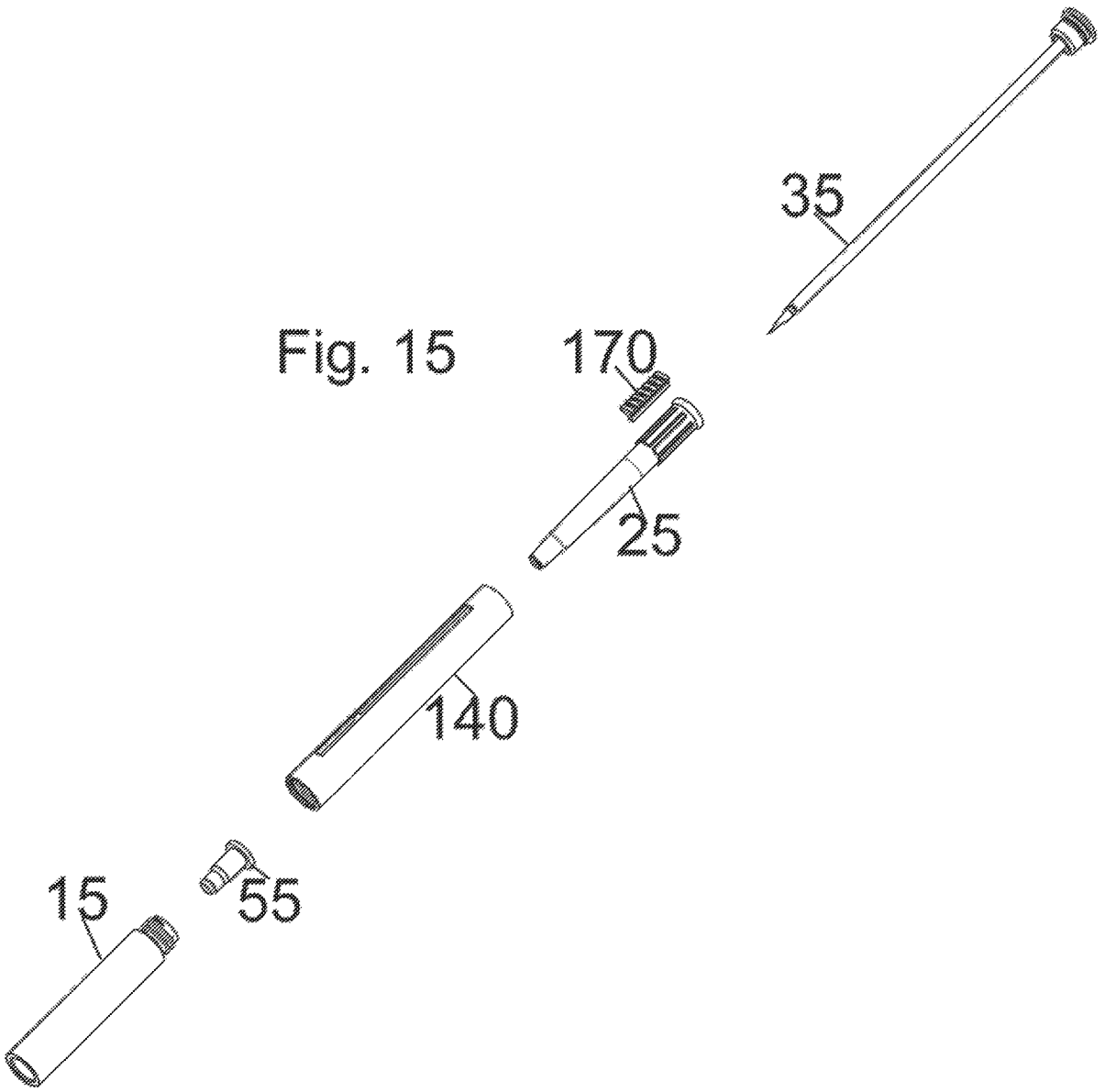
FIG. 15 is an exploded view of the embodiment shown in FIG. 11.

There is a channel or opening in the housing of the closure portion that allows the user to push the tab from a first to a second position; there can be ridges, bosses or bumps on the tab; the tab has a first tab end (for the user's finger) and a second tab end, which is connected to the sliding sleeve or sheath. In FIG. 14, the second end of sliding sleeve can have a boss or male piece that engages a receiving portion on the second end of the stem at the cap end. In FIG. 15, there are a stem; a tab; a sliding sleeve; a slotted housing body; a wiper and a bottle portion.

Detailed embodiments of the present invention are disclosed; however, it is to be understood that the disclosed embodiments are merely exemplary of the invention, which can be embodied in various forms. Specific structural and functional details disclosed are not to be interpreted as limiting, but merely as a basis for the claims and as a representative basis for teaching one skilled in the art to variously employ the present invention in virtually any appropriately detailed structure. The title, headings, terms and phrases used are not intended to limit the subject matter or scope; but rather, to provide an understandable description of the invention. The invention is composed of several sub-parts that serve a portion of the total functionality of the invention independently and contribute to system level functionality when combined with other parts of the invention.

The terms "a" or "an" are defined as one or more than one. The term plurality, as used herein, is defined as: two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Para. 6. Use of "step of" in the claims is not intended to invoke the provisions of 35 U.S.C. Sec. 112, Para. 6. All publications, patents, and patent applications mentioned are incorporated by reference to the same extent as if each reference was specifically and individually indicated to be incorporated by reference.

We claim:

1. An apparatus for applying a cosmetics product by a user comprising:

a bottle portion configured to hold the cosmetics product, a closure portion, having:

a housing having an interface to removably connect to the bottle portion, a stem connected to the housing, a sliding hollow sleeve positioned within the housing and slidable therein, a biasing element in the form of a compression spring surrounding the stem, wherein the compression spring and the stem allow the sliding sleeve to have the first retracted position and the second extended position and bias the sleeve out and extending from an open end of the housing, and an applicator tip; and a wiper structure at an open end of the bottle portion, the wiper structure having a resistance point and the sliding sleeve configured to engage the resistance point of the wiper.

2. The apparatus of claim 1, wherein the wiper structure allows the applicator tip to engage the cosmetics product within the bottle portion.

3. The apparatus of claim 1, wherein in the first retracted position, the sliding sleeve is positioned within the housing, and the applicator tip engages the cosmetics product within the bottle portion, and in the second extended position, when the closure portion is separated from the bottle portion, the biasing element extends the sliding sleeve from within the housing and allows the user to grip the eyeliner mechanism near the applicator tip without getting the cosmetic product onto fingers of the user.

4. The apparatus of claim 3, wherein the housing of the closure portion and the bottle portion having connecting surfacing including threaded mated connections, friction connections, or magnetic connections.

5. The apparatus of claim 3, wherein the wiper has a resistance point, and the sliding sleeve can engage the resistance point of the wiper.

6. The apparatus of claim 1, further comprising a compression spring surrounding the stem, wherein the compression spring and the stem allow the sliding sleeve to have a first retracted position and a second extended position.

7. The apparatus of claim 6, wherein the stem has a graduated and tapered outer surface.

8. An apparatus for applying a cosmetics product by a user comprising:

a bottle portion configured to hold the cosmetics product;

a closure portion, having:

a housing having an interface to removably connect to the bottle portion, a sliding hollow sleeve positioned within the housing and slidable therein, a biasing element in the form of a compression spring surrounding a stem of the housing, wherein the compression spring and the stem allows the sliding sleeve to have a first retracted position and a second extended position relative to the housing, the biasing element configured to bias the sleeve in the second extended position, and an applicator tip; and a wiper structure at an open end of the bottle portion, the wiper structure allows the applicator tip to engage the cosmetics product within the bottle portion, wherein the wiper has a resistance point, and the sliding sleeve can engage the resistance point of the wiper.

9. The apparatus of claim 8, wherein in the first retracted position, the sliding sleeve is positioned within the housing, and the applicator tip engages the cosmetics product within the bottle portion, and in the second extended position, when the closure portion is separated from the bottle portion, the biasing element extends the sliding sleeve from within the housing and allows the user to grip the eyeliner mechanism near the applicator tip without getting the cosmetic product onto fingers of the user.

10. The apparatus of claim 8, wherein an end of the sleeve is tapered.

11. The apparatus of claim 8, further comprising a stem connected to the housing.

12. The apparatus of claim 11, wherein the stem has a graduated and tapered outer surface.

13. An apparatus for applying a cosmetics product by a user comprising: a bottle portion configured to hold the cosmetics product, a closure portion, having:

a housing having an interface to removably connect to the bottle portion, a stem connected to the housing, a sliding hollow sleeve positioned within the housing and slidable therein, a biasing element in the form of a compression spring surrounding the stem, wherein the compression spring and the stem allows the sliding sleeve to have a first retracted position and a second extended position relative to the housing, the biasing element configured to bias the sleeve in the second extended position; and an applicator tip; and a wiper structure at an open end of the bottle portion, the wiper structure allows the applicator tip to engage the cosmetics product within the bottle portion.

14. The apparatus of claim 13, wherein in the first retracted position, the sliding sleeve is positioned within the housing, and the applicator tip engages the cosmetics product within the bottle portion, and in the second extended position, when the closure portion is separated from the bottle portion, the biasing element extends the sliding sleeve from within the housing and allows the user to grip the eyeliner mechanism near the applicator tip without getting the cosmetic product onto fingers of the user.

15. The apparatus of claim 13, wherein the wiper has a resistance point, and the sliding sleeve is configured to engage the resistance point of the wiper.

16. The apparatus of claim 13, wherein an end of the sleeve is tapered.

17. The apparatus of claim 13, further comprising a compression spring surrounding the stem, wherein the compression spring and the stem allow the sliding sleeve to have the first retracted position and the second extended position.

18. The apparatus of claim 13, wherein the stem has a graduated and tapered outer surface.

* * * * *